US005869756A

United States Patent [19]

Doherty et al.

[11] Patent Number: 5,869,756

[45] Date of Patent: Feb. 9, 1999

[54] MOORED WATER PROFILING APPARATUS

[76] Inventors: Kenneth W. Doherty, 87 Blacksmith Shop Rd., Falmouth, Mass. 02540; John M. Toole, 58 Bay Rd., North Falmouth, Mass. 02556; Daniel E. Frye, 17 Watson Dr., Mashpee, Mass. 02649

[21] Appl. No.: 797,714

[22] Filed: Feb. 11, 1997

[51] Int. Cl.[6] ..... G01W 1/00; B63B 22/00

[52] U.S. Cl. ..... 73/170.29; 73/864.67; 405/192; 405/188

[58] Field of Search ..... 405/185, 187–194; 73/170.29, 170.34, 864.67, 864.66, 864.62

[56] References Cited

U.S. PATENT DOCUMENTS

| | | | |
|---|---|---|---|
| 3,552,205 | 1/1971 | Francis | 73/170.34 |
| 3,592,014 | 7/1971 | Brown et al. | 405/169 |
| 3,935,592 | 1/1976 | Dahlen et al. . | |
| 3,991,623 | 11/1976 | Murdock . | |
| 4,215,572 | 8/1980 | Spiess . | |
| 4,352,595 | 10/1982 | Scodino | 405/172 X |
| 4,854,728 | 8/1989 | Baron et al. . | |
| 4,924,698 | 5/1990 | Echert et al. . | |
| 5,095,841 | 3/1992 | Santos et al. . | |
| 5,303,600 | 4/1994 | Wood et al. | 73/864.62 |
| 5,555,518 | 9/1996 | Whalen et al. . | |
| 5,644,077 | 7/1997 | Fowler . | |

OTHER PUBLICATIONS

John Van Leer, Walter Düing, Robert Erath, Edward Kennelly and Arthur Speidel, Instruments and Methods The Cyclesonde: an Unattended Verticle Profiler for Scalar and Vector Quantities in the Upper Ocean, Dee–Sea Research, 1974, 385–400, vol. 21, Pergaman Press, Great Britain.

Charles C. Erikson and John M. Dahlen and John T. Shillingford, Jr., An Upper Ocean Moored Current and Density Profiler Applied to Winter Conditions Near Bermuda, Journal of Geophysical Research, Sep. 20, 1982, pp. 7879–7902, vol. 87, No. C10, American Geophysical Union, U.S.

*Primary Examiner*—Dennis L. Taylor

*Attorney, Agent, or Firm*—William B. Ritchie; Michael J. Persson

[57] ABSTRACT

A water profiling apparatus having a streamlined body with a traction drive capable of repeatedly profiling along a moored or suspended cable or wire, for transporting sensing and sampling equipment through a body of water, such as an ocean, lake or river. The water profiling apparatus is able to operate unattended on a pre-programmed schedule over long periods of time, profiling to full ocean depth, with the option of changing its schedule depending on the observations it makes or operating situations encountered.

15 Claims, 5 Drawing Sheets

MOORED WATER PROFILING APPARATUS

BACKGROUND OF THE INVENTION

1. Field of the Invention

The invention relates to techniques for observing properties of bodies of water at a fixed location, particularly observations in regions of great depth over a period of time.

2. Description of the Related Art

Measurements of physical and chemical attributes of water bodies are commonly made by lowering instruments from a surface boat to the bottom of an ocean, lake or river. Water depths can range from a few meters to nearly ten thousand meters. The location from which the data is taken is commonly referred to as a hydrographic station. The water properties can change substantially over time. Therefore, the frequency of measurement needs to be commensurate with the rate of change of the water properties.

The frequency that these measurements can be made is governed by the logistics of re-occupying the observation locations or stations. It is now recognized that a number of important ocean circulation and limnological phenomena occur episodically, and that there are short and long-term changes in water properties. More frequent sampling, or sampling initiated by a measured change in the environment, is important and is needed to elucidate ocean or lake behavior.

While such frequent measurements have been extremely difficult to obtain, the limited number of studies that have re-occupied the same site many times over time have proven to be extremely valuable. For example, an investigation by J. R. Lazier in 1980 of the Labrador Sea documented the effect of low-salinity surface water on deep water convection. Undoubtedly, many other important discoveries concerning ocean water circulation await the ability to obtain long term profiles of water properties.

Long-term measurements at fixed locations are generally made using moored instrument systems. At a limited number of preselected depths, an instrument package is affixed to the mooring cable which is anchored to the sea floor. While this is preferable to single observations, the profile over time is severely constrained by a limited number of sampling depths. Since each preselected depth requires its own complete instrument package, the cost to obtain the data increases proportionately to the number of sites selected. Maintaining calibration of many instrument packages is time consuming and expensive.

It has been recognized that a single sensor platform that can move up and down the mooring cable provides distinct advantages by eliminating the need for multiple sensors and multiple tethering systems. It also provides the advantages of a single calibration applicable to all of the measurements. This is particularly important in long term measurements where sensor drift over time may be large compared to the ocean variability.

One such device is made by Brooke Ocean Technology, Ltd. of Dartmouth, Nova Scotia. This apparatus utilizes surface wave motion as an energy source to power a three-mode microprocessor controlled ratchet system. The apparatus can be locked in place, set to free fall, or engaged to climb down the mooring cable. The apparatus requires wave heights of at least 15 cm at a 2 second period to operate. The descent rate is much slower than the climb rate, and the cycle time differs considerably from one cycle to another. This device has a limited depth range over which it can operate, and requires attachment to a surface buoy rather than a subsurface float. This requirement results in reliability problems due to the dynamic forces created by waves.

Detailed sampling of the ocean's vertical property variations is also commonly accomplished by using expendable bathythermographs such as manufactured by the Sippican Corporation of Marion, Mass. and as disclosed in U.S. Pat. No. 3,552,205, issued to Francis and U.S. Pat. No. 5,555,518, issued to Whalen. This sonde has a streamline-shape so that it will free fall at a constant and predictable rate. The instrument package within the device is connected by thin insulated copper wire which unspools as the device drops, thus providing a profile of water conditions as the sensors within the device send back data. These devices are capable of depths to one kilometer, that is, only the upper portion of the ocean which has an average depth of 3½ kilometers. This type of device is poorly suited for time series measurements since it requires that a ship stay at the station in order to collect the data. Also, since the device is expendable, the cost of sampling becomes prohibitive for studies that require frequent sampling.

U.S. Pat. No. 4,924,698, issued to Echert et al. on May 15, 1990, discloses an ocean profiler that is designed to be used under pack ice via a tether connected to a stationary surface buoy. The apparatus moves up and down its tether via a variable pitch hydrofoil "wing". The "wing" flies up or down in response to the ocean currents. As with the previously described device, a constant rate of movement up or down or a constant cycle period is not possible since the ocean currents are as changeable as wave height. Use of this device is limited to areas with significant current shear. Depths to 300 meters were typical in the Echert disclosure.

Other approaches to ocean profiling have been attempted. One approach has been the use of a device that adjusts its buoyancy to provide movement up or down along the mooring line via compressed gas. Representative of this genre is the CYCLESONDE invented by J. W. Van Leer et al, as described in *Deep Sea Research.*, vol. 21, pp. 385–400, 1974. Another example is the Webb Research Corp.'s "SLOCUM" is an example of a freely drifting vehicle which can ascend and descend by changing buoyancy.

A buoyancy variant using a pump to move a working fluid into and out of the device is the profiler that was described by Eriksen et al. in the *Journal of Geophysical Research*, Vol. 87, No. C10, pp. 7879–7902, Sept. 20, 1982. This device, referred to as a profiling current meter has its buoyancy adjusted by computer control. The design is said to decouple the instrument from the vertical motions of the mooring induced by surface waves. Its depth range is limited to a few hundred meters.

There is not found in the prior art an apparatus that moves at a constant speed along its mooring cable, either up or down, that has a cycle time, i.e., from top to bottom and back, which corresponds to the spectrum of changes in the water body being measured, that can profile over the full depth of the ocean, that can profile 1,000,000 meters on a single internal battery, that can control its motion completely, that orients into the current, and has the reliability and energy requirements suitable for making measurements over a long period of time while unattended.

SUMMARY OF THE INVENTION

It is an aspect of the invention to provide a moored water profile apparatus that eliminates much of the logistic and cost limitations of making hydrographic stations at sufficient frequency to provide a substantive water profile of a body of water.

Another aspect of the invention is to provide a moored water profile apparatus that can be used to make mobile in situ observations and take samples of transient changes.

It is still another aspect of the invention to provide a moored water profile apparatus that can make measurements with an apparatus moving at a constant speed, both up and down, so to assure constant water flow past the sensors at a rate appropriate to their equilibration time.

It is an aspect of the invention to provide a moored water profile apparatus that has the ability to have one or more sensors vertically traverse a body of water repeatedly while unattended and to have a single calibration suffice for all of the measurements.

It is still another aspect of the invention to provide a moored water profile apparatus that has the ability to store and/or telemeter the information gathered.

Another aspect of the invention is to provide a moored water profile apparatus that has the ability to telemeter data and status information via an inductive link or an acoustic link, and to have its observing schedule revised remotely.

Another aspect of the invention is to provide a moored water profile apparatus that can adequately sample a body of water at periodicities appropriate to the spectrum of changes typically occurring in the water body and to allow control of the profiling strategy to best accomplish the scientific or surveillance objectives.

The invention is a water profiling apparatus for use with a mooring member affixed in a body of water from a float or buoy (usually subsurface). One end of the mooring member is preferably tethered to an anchor. A traction mechanism is provided that holds said apparatus to the mooring member so that said traction mechanism is able to propel said apparatus along the mooring member at a predetermined substantially constant rate of movement. Sensor feedback is used as part of the control system to reverse direction and stop at predetermined locations. An outside shell having low hydrodynamic drag that is self-orienting towards a current flow within said body of water is also provided.

Other aspects and advantages of the present invention will become apparent and obvious from a study of the following description and the accompanying drawings which are merely illustrative of the invention. In the figures and written description, numerals indicate the various features of the invention, like numerals referring to like features throughout both the drawing figures and the written descriptions.

DETAILED DESCRIPTION OF THE INVENTION

Figure 1:
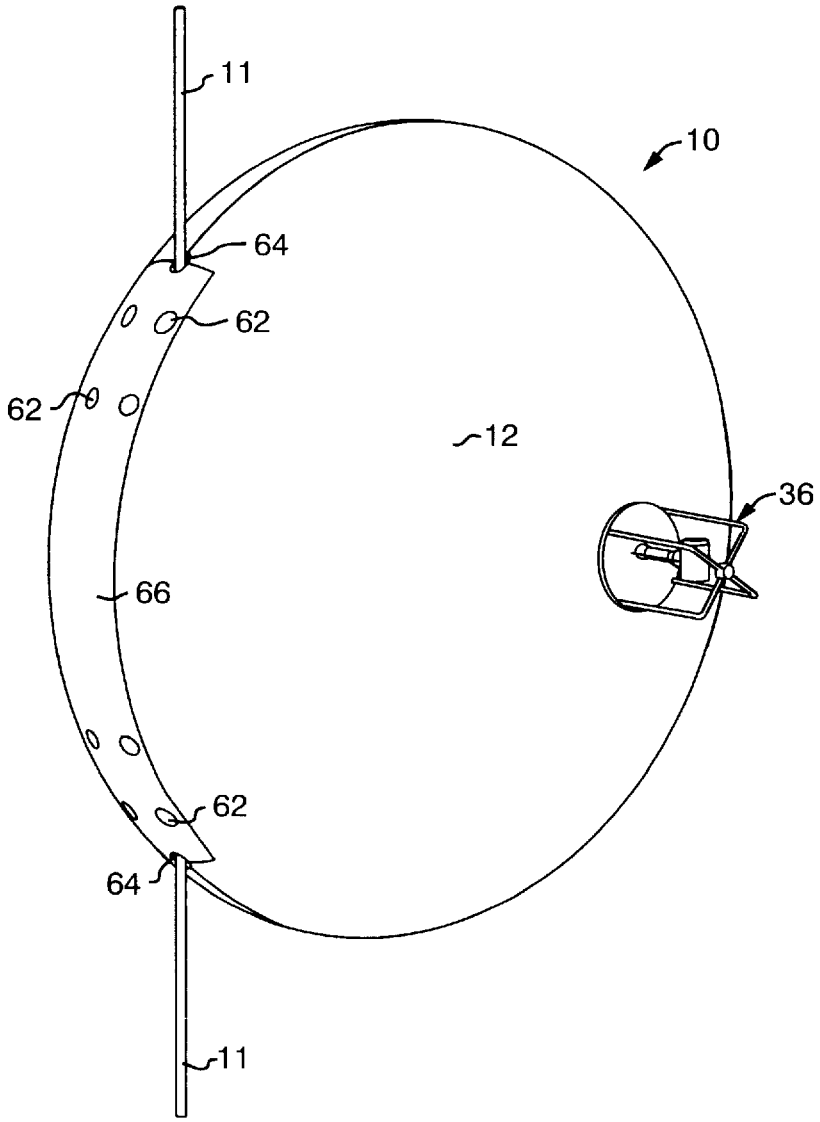
FIG. 1 is an oblique perspective view of the moored water profiling apparatus in accordance with the invention.
Figure 2:
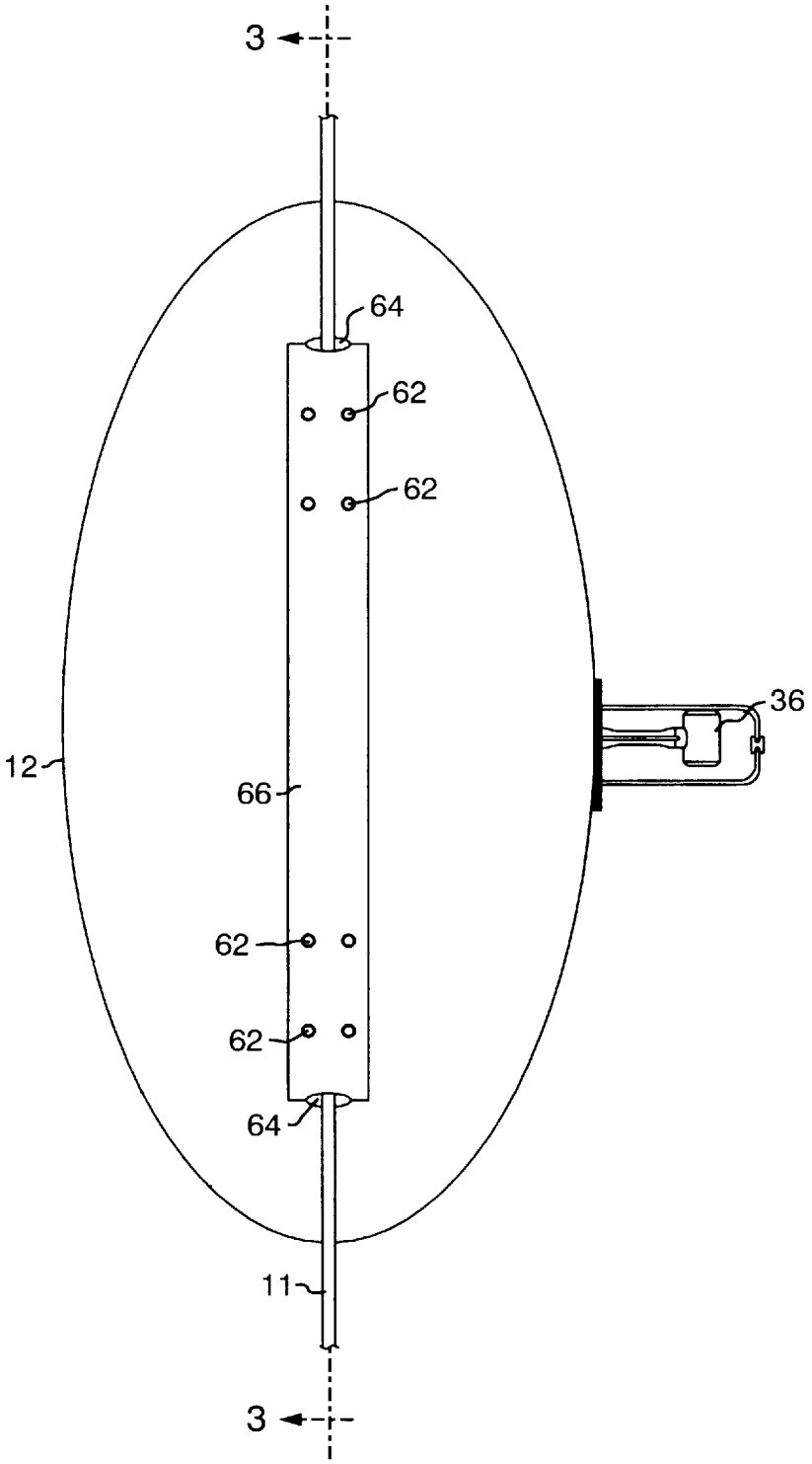
FIG. 2 is a front view of the invention.
Figure 3:
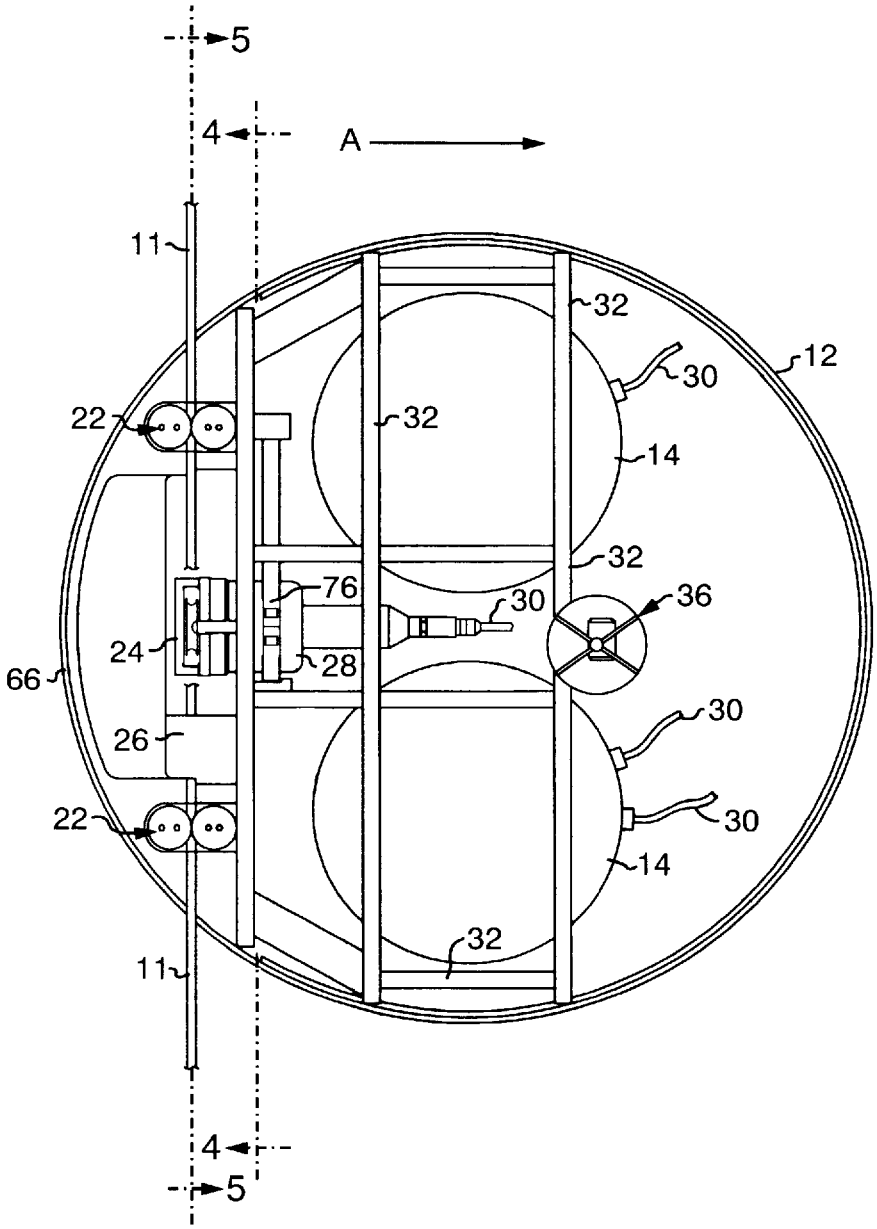
FIG. 3 is a cross-sectional view across section lines 3—3 as shown in FIG. 2.
Figure 4:
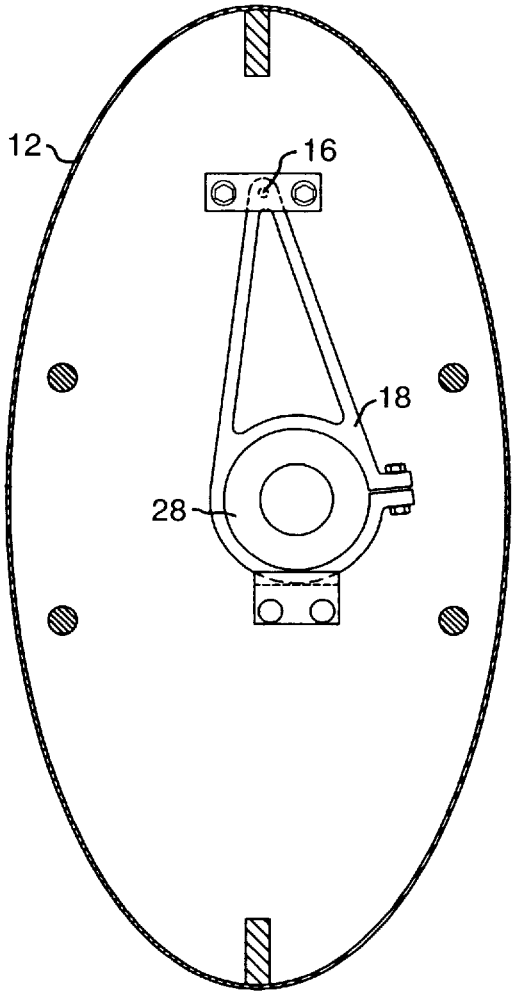
FIG. 4 is a cross-sectional view across section lines 4—4 as shown in FIG. 3.
Figure 5:
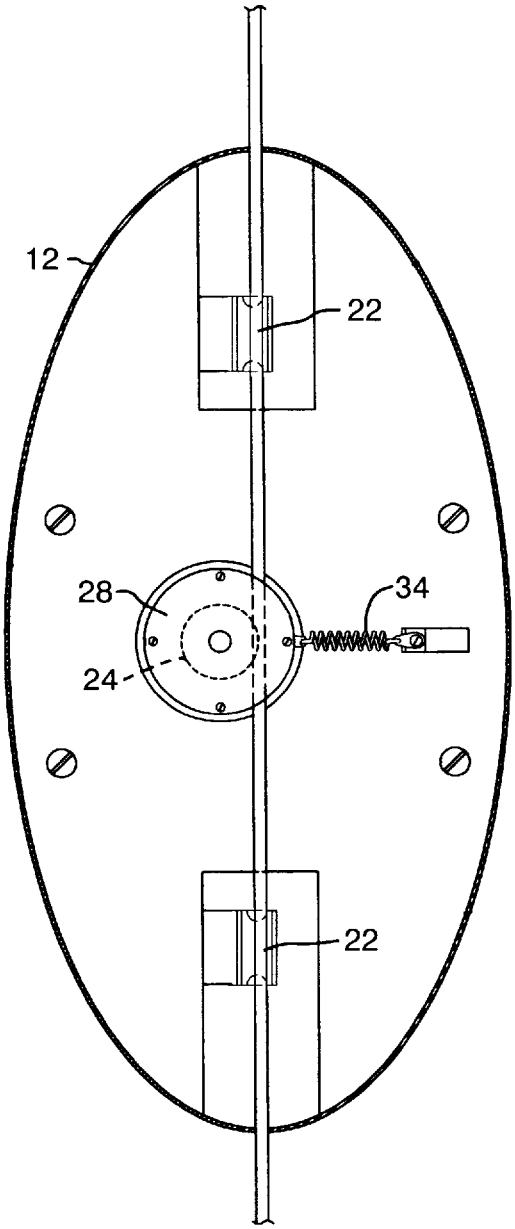
FIG. 5 is a cross-sectional view across section lines 5—5 as shown in FIG. 3.

Referring now to FIGS. 1–5, invention 10 is a moored water profiling apparatus adapted for holding one or more instruments, and optionally, one or more fluid samplers. The overall shape of invention 10 is streamlined in the direction of travel in a current flow A (FIG. 3), preferably the shape is that of an oblate-spheroid, however, other streamlined shapes would also be acceptable. Invention 10 has openings 64 through which a near vertical cable/wire 11 passes, allowing invention 10 to travel along the cable 11. While a wide range of sizes and materials can be selected for use as cable 11, cable 11 is preferably standard wire rope or electromechanical cable having a diameter typically ranging from 3/16" to ½". However, larger diameters could also be used. Cable 11 could be either laid or double armored. Typically such cables are made from steel, however, other materials would also be acceptable. While it is expected that cable 11 will usually be in a substantially vertical orientation (tilting up from 10 degrees to 20 degrees depending on the current), a vertical orientation for cable 11 is not essential since invention 10 could be used to travel along a horizontally positioned cable 11 if desired. Invention 10 could also be used to travel along cable 11 that was first substantially horizontal, then changing to a substantially vertical orientation as is experienced when the length of the mooring cable is significantly greater than the water depth.

A traction mechanism is used to move invention 10 up and down cable 11 rather than the use of variable displacement to accomplish this. The inventors have determined that a traction drive developed using a spring to position a grooved drive wheel against cable 11 is potentially better able to overcome potential problems by exerting extra force if an obstruction is encountered. The spring allows the drive wheel to roll over small obstructions. In addition, stopping at predetermined depths can be accomplished by merely shorting the motor terminals, thus, effectively locking invention 10 onto cable 11. A variable displacement device requires a separate brake mechanism and/or high pressure valves to stop at a particular depth. Finally, a traction drive is better suited to performing multiple excursions to intermediate or shallow depths than is a variable buoyancy drive because it is more energy efficient when reversing direction.

However, in order to minimize the energy requirements to transport invention 10 using the traction mechanism, it is preferable that invention 10 be close to neutrally buoyant. The invention accomplishes this without pressure or temperature compensation by keeping the displaced volume to a minimum.

The traction mechanism uses two pairs of grooved guide wheels 22 and a drive wheel 24. One pair of grooved guide wheels 22 are on the main housing and the other pair are on a detachable face plate 66. Face plate 66 is removed by loosening bolts 62 so that cable 11 can be inserted within guide wheels 22 and drive wheel 24. The apparatus is attached and removed from the cable 11 by mechanical fasteners between the two pairs of guide wheels 22. Guide wheels 22 are preferably made of ACETRON-NS. Guide wheels 22 preferably have torlon bearings. However, other materials suitable for marine use would also be acceptable. Drive wheel 24 and the housing are preferably made of grade 5 titanium (6A1–4 V). Again, other materials having similar properties could be substituted. To ensure reliable operation, drive wheel 24 is preferably coated with urethane using techniques well known in the art.

The axis of the two pairs of guide wheels 22 and the drive wheel 24 are preferably at right angles to one another. The motor 28 and its drive wheel 24 are clamped in a bracket 18 pendulously suspended from pivot pin 16. One or more springs 34 which are in tension, pull drive wheel 24 against cable 11.

The wheel V-shaped grooving in drive wheel 24 is commensurate with the size of the cable along which the apparatus moves. An elastomer coating such as urethane on the drive wheel 24 can enhance the lifetime of the drive wheel, improve traction, and reduce rolling friction. The drive wheel 24 is driven by motor 28. Motor 28 is preferably a direct current motor such as the rare-earth neodium magnetic type manufactured by Maxon Precision Motors of Fall River, Mass. The specifications for 20 this motor are as follows: voltage is 13.8 volts, no load speed is 110 rpm, stall torque is 2340 mNm, loaded speed is 109 rpm; loaded torque is 40 mNm; 33.2 to 1 planetary reduction gear load, and the overall efficiency including the gear head is approximately 62%.

A magnetic coupling can be used to transmit the motor's torque to the drive wheel 24 obviating the need for friction-prone, energy-consumptive rotational shaft seals. The speed of the apparatus along the cable 11 is user-defined and typically is 0.2 to 2 meters per second, but can be slower or faster to meet the measurement requirements. Pressure-resistant canisters 14 contain the controller, the recorder, and the power for the traction mechanism. Mated glass hemispheres, 25, 30 or 43 cm in diameter, are suitable pressure-resistant canisters 14. Underwater connectors 30 (only partially shown for clarity), well known in the art, are used to interconnect the components. Batteries, such as lithium, alkaline or nicads, are typically used for power for the drive motor 28, control and recording equipment. An overall exterior shell 12, preferably of fiberglass or plastic, is used to provide a hydrodynamically smooth shape to reduce the drag due to the vehicle's movement and ambient currents, and to protect the apparatus during shipboard deployment and recovery handling, and from attack and fouling by organisms. The preferable shape for shell 12 is an oblate-spheroid having an aspect ratio of about 2:1, thus providing a drag coefficient of about 0.2. This provides a uniform frontal cross-section irrespective of the direction of travel. This shape and the off-center cable conduit allows the vehicle to orient itself into the ambient current as it traverses the cable 11 up and down the water column. This configuration also allows an instrument such as a current meter to be positioned into the flow in order to obtain an unbiased measurement. A magnetic compass can be used to record the apparatus' orientation and current direction at any depth. While the position of the compass within shell can vary, it should be placed away from electrical leads.

Sensors 36 mounted on housing 12 are not contaminated by the instrument wake. Examples of sensors are conductivity, temperature and pressure sensors. If mooring cable 11 is metallic and insulated, it can be used as a telemetry link for transmitting data and status using an inductive modem 26, such as commercially available from Falmouth Scientific of Falmouth, Mass. Alternatively, acoustic telemetry such as commercially available from Datasonics, of Cataumet, Mass., can be used.

Aluminum, steel, titanium, fiberglass and plastics can be used for structural elements 32, coverings 12, and face plate 66. Spring 34, acting on pivot 16, holds the drive wheel 24 against cable 11. Choice of materials is dictated by the maximum pressure to be encountered, and the size which is determined by the sampling equipment and power required.

The inventors have built a prototype which is about 0.7 meters in diameter, has two pressure-resistant canisters, is neutrally buoyant in water and weighs about 36 kg in air. Another prototype, 0.8 meter in diameter, weighing 45 kg in air and neutrally buoyant in water, has a larger payload in three pressure-resistant canisters. The internal space within the housing is flooded with sea water once the unit is submerged. As the apparatus size increases, the drag increases requiring significantly more stored energy. As the apparatus size decreases, the available space to house instruments decreases rapidly. For oceanographic and limnological instrumentation in current use, overall sizes in the range of 0.5 to 1.5 meters in diameter are preferable.

A prototype of the invention 10 has successfully made hundreds of ascents and descents on a mooring cable over a thousand meters long, traversing over a thousand kilometers on a single set of batteries. Optimum speeds are in the range of 0.1 to 1 meters per second. At 0.3 meters per second, the power required is 3.3 Joules, and overall efficiency is about 40%.

Most of the buoyancy needed to make the apparatus neutrally buoyant, overall, can be provided by glass spheres 14 such as commercially available from Benthos, In. of North Falmouth, Mass. or Billings Industries of Pocasset, Mass. Spheres 14 can also serve as the pressure-resistant canisters which house batteries, control and recording equipment. Pressure-rated foams, such as commercially available from Flotation Technologies of Biddleford, Me., can be used for both structural members and buoyancy. Density compensation to keep the unit very nearly neutrally buoyant is achieved by balancing the greater and lesser compressibilities of components. Instrument and battery pressure housings are typically less compressible than water, while oils are more compressible than water.

There are several choices of bearings to support the drive wheel, varying greatly in cost. One example is ball bearings which can be immersed in salt water constructed of silicon nitride.

A small, low-powered, commercially-available computer such as "Tattle Tale 6F", manufactured by Onset Computer Corp. of Cataumet, Mass. is used for control and data recording. Programming can be adapted to the specific task at hand and can include "problem solving." For example, if progress is impeded (say by mooring biofouling), the profiler instructions cause it to back up and try again to advance past the problem spot on the cable 11. After a user-specified number of tries without success, the instrument abandons that cycle and proceeds to the next.

Sensors that can be mounted on the vehicle include, but are not limited to temperature, conductivity, currents, depth, light levels, fluorescence, oxygen and other chemical species sensors which are well known in the art. The procedures for acquisition, processing and storage of such sensor data are in common use.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A water profiling apparatus for use with a mooring member affixed in a body of water, said apparatus comprising:

a substantially hollow shell dimensioned to accommodate a plurality of sensors, said shell comprising a pair of openings positioned and dimensioned to allow said mooring member to be disposed through said shell; and a traction mechanism disposed within said shell and dimensioned for movable attachment to said mooring member, said traction mechanism being adapted to propel said shell at a predetermined and substantially constant rate of movement relative to said mooring member.

2. The apparatus as claimed in claim 1 wherein said shell is dimensioned to produce a hydrodynamically low-drag that is self-orienting towards a current flow within said body of water.

3. The apparatus as claimed in claim 1 wherein at least one sensing device is disposed within said shell and wherein said at least one sensing device is selected from the group consisting of conductivity sensors, temperature sensors, pressure sensors, current velocity sensors, light level sensors, fluorometers, and chemical sensors.

4. The apparatus as claimed in claim 3 further comprising telemetry means for transmitting information obtained from said sensing device.

5. The apparatus as claimed in claim 1 wherein said mooring member is substantially vertical.

6. The apparatus as claimed in claim 1 wherein said mooring member is substantially horizontal.

7. The apparatus as claimed in claim 1 wherein said mooring member has both a substantially vertical portion and a substantially horizontal portion.

8. The apparatus as claimed in claim 1 wherein said traction mechanism.

9. The water profiling apparatus as claimed in claim 1 wherein said mooring member is a cable and wherein said traction mechanism comprises:

at least two pairs of grooved guide wheels dimensioned to grasp said cable;

a grooved drive wheel dimensioned to contact said cable and propel said profiler relative to said cable;

a spring adapted to position said grooved drive wheel against said cable;

a motor in communication with said grooved drive wheel such that a torque produced by said motor is transmitted to said grooved drive wheel;

a controller for controlling the torque produced by said motor; and a power source for supplying power to said controller and said motor.

10. The water profiling apparatus as claimed in claim 9 wherein an axis of said at least two pairs of grooved guide wheels and an axis of said grooved drive wheel are disposed at right angles to one another.

11. The water profiling apparatus as claimed in claim 9 wherein said grooved guide wheels further comprise torlon bearings.

12. The water profiling apparatus as claimed in claim 9 wherein said drive wheel is coated with urethane.

13. The water profiling apparatus as claimed in claim 9 further comprising a bracket and a pivot pin and wherein said bracket is pendulously suspended from said pivot pin and said motor is affixed to said bracket.

14. The water profiling apparatus as claimed in claim 9 further comprising a magnetic coupling and wherein said magnetic coupling is disposed between said motor and said drive wheel such that the torque produced by said motor is transmitted to said grooved drive wheel.

15. The water profiling apparatus as claimed in claim 9 further comprising pressure resistant canister and wherein said controller and said power source are disposed within said pressure resistant canister.

* * * * *